United States Patent [19]

Schiller

[11] Patent Number: 5,027,621

[45] Date of Patent: Jul. 2, 1991

[54] STRAP EDGER ASSEMBLY

[76] Inventor: Barry Schiller, 720 N. Flagler, Ft. Lauderdale, Fla. 33304

[21] Appl. No.: 341,585

[22] Filed: Apr. 21, 1989

[51] Int. Cl.[5] ..... C14B 5/04

[52] U.S. Cl. ..... 69/002; 69/006; 83/858

[58] Field of Search ..... 69/17, 6, 7.7, 21, 2; 409/138, 303, 345, 346; 269/217, 236, 256; 83/858

[56] References Cited

U.S. PATENT DOCUMENTS

| | | | |
|---|---|---|---|
| 66,589 | 7/1867 | Hill | 69/6 |
| 140,404 | 7/1873 | Coe | 269/256 |
| 399,965 | 3/1889 | Bradley | 69/6 |
| 443,678 | 12/1890 | James | 69/6 |
| 454,480 | 6/1891 | Keck | 69/2 |
| 850,591 | 4/1907 | Larson | 69/6 |
| 897,256 | 8/1908 | Fraser et al. | 409/303 |
| 2,690,910 | 10/1954 | Tuck | 69/2 |
| 4,805,505 | 2/1989 | Cantlin | 269/236 |

FOREIGN PATENT DOCUMENTS

| | | | |
|---|---|---|---|
| 114906 | 10/1876 | France | 69/17 |

*Primary Examiner*—Hien H. Phan

*Attorney, Agent, or Firm*—Malloy, Downey & Malloy

[57] ABSTRACT

A bench mounted and manually operated strap edger assembly structured to shape, parallel and reduce strap edges to a desired uniform width or thickness depending, at least to some extent upon the application for with the strap edger is intended. Each of two knife holders are adjustably mounted on a support base such that the cutting edge of one knife secured to a respective holder may be independently and fixedly adjusted relative to the longitudinal edge of the strap being shaped. The second knife and attached knife holder are movable between a fully opened and a plurality of cutting positions so that; the leading end of the strap is easily and operatively positionable relative to the cutting blade with the second knife holder in the fully opened position; facilitating a strong hand hold thereon enabling the user of the such assembly to pull the strap through the edger assembly once moving the second knife into one of the cutting positions to accomplish the intended operation.

12 Claims, 3 Drawing Sheets

FIG. 3
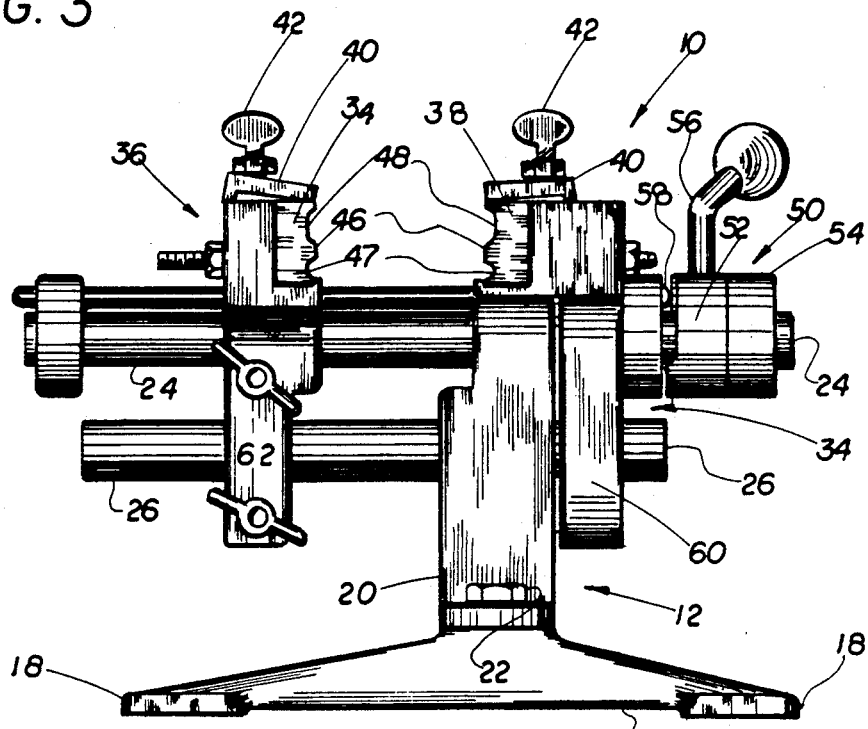
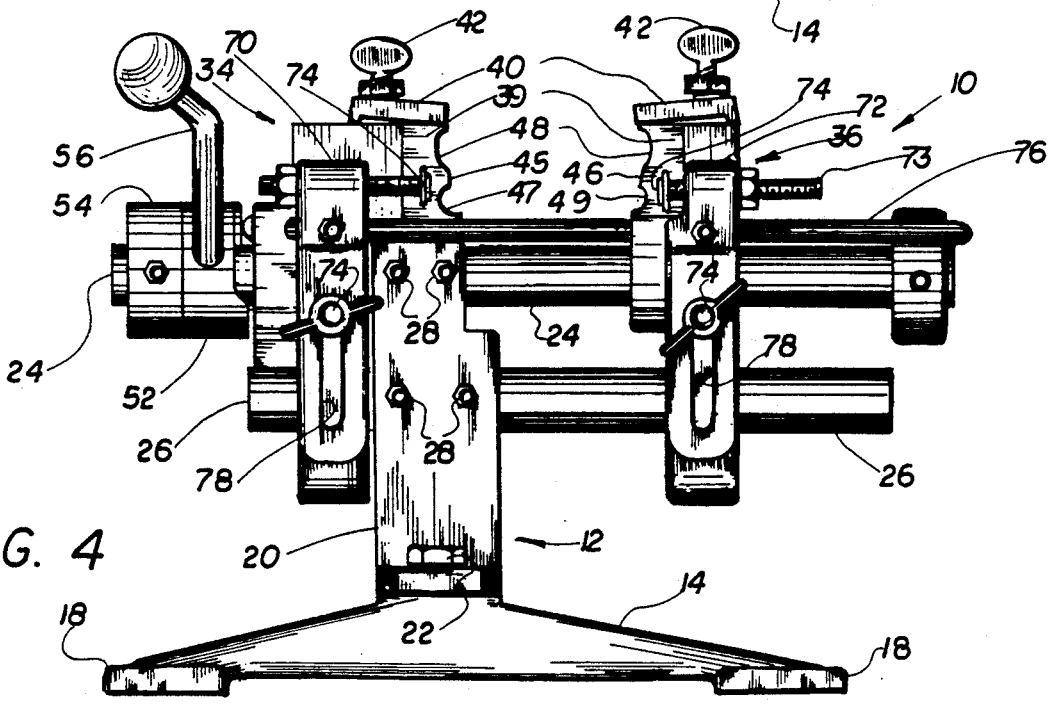
FIG. 4

STRAP EDGER ASSEMBLY

BACKGROUND OF THE INVENTION

1. Field of the Invention

This invention relates to a low cost and operable bench mounted strap edger machine particularly designed to shape, by cutting, one or both longitudinal edges of a leather or other material strap wherein the strap may easily be positioned operatively relative to the cutting edges of the knives in a manner which facilitates gripping of the leading edge thereof to accomplish a pulling action on the strap being processed.

2. Description of the Prior Art

In the use of the elongated leather or other, like material straps it is common practice to shape, by cutting, the longitudinal edges thereof in a preferred manner, depending upon the use for which the strap is intended. Such straps typically are used as belts, harness, etc. Also, in the operation of machines of this type it is common practice to provide manual force, such as a pull force on the strap when performing the determined cutting operation thereon.

One problem associated with machines of this type, is the inability to easily position the strap for cutting, shaping, etc., in a manner which allows an operator of the machine or assembly to obtain a firm, strong hand hold on a leading portion of the strap in order to exert the necessary pulling force thereon.

Accordingly, there is an obvious need for machines of this type particulalry designed to be operated by a manual pull which serves force being exerted on one end of the material being processed to easily and accurately position the cutting blades relative to the longitudinal edges of the strap. Also such a preferred assembly should facilitate the ability for the operator to firmly grip the strap and exert the proper pulling force thereon. This enables the strap to travel through the machine relative to and against the cutting force exerted on the edges surrounding the other portions of the strap by the knife blade structure.

SUMMARY OF THE INVENTION

The present invention relates to a strap edger assembly of the type designed to be bench mounted and manually operated and designed expressly to shape, parallel and reduce the longitudinal edges of a leather or like material and conform the strap to a desired width. The assembly comprises of a base, including a main base upright with a support platform secured to one end thereof. The support platform is structured to be secured in a conventional manner to a work bench or a table in an appropriate location. Two spaced apart parallel support shafts are mounted on the main base upright and each includes an elongated configuration disposed transversely to the main base upright.

The assembly further includes two knife holder structures referred to herein for purposes of clarity, as inboard and outboard knife holders. The inboard knife holder is mounted on the support shafts in cooperative, substantially adjacent relation to the main base upright. The outboard knife holder, is also supported on the support shafts on the opposite side of the main base upright. The outboard knife holder is selectively adjustable along the length of the support shafts so as to accurately and temporarily position the knife blade and cutting edges thereof into operative position relative to a longitudinal edge of the strap being shaped.

A locking means will fixedly secure the outboard knife holder in an intended operative position relative to the corresponding longitudinal edge of the strap. However, an important feature of the present invention is the interconnection of the inboard knife holder to the main base upright by a biasing means so as to effectively spring load the inboard knife holder on the main base upright.

Relative positioning of the inboard knife holder to a corresponding opposite longitudinal edge of the strap being processed is accomplished by an adjustment means including a driving cam structure. The cam structure is movable by manipulation of an elongated handle into a full open position and a plurality of cutting positions. The full open position, allows the maximum outward spacing of the inboard knife holder from the main base upright due to the biasing force exerted on the knife holder. The cam is further and selectively positionable into a plurality of the cutting positions, which determines the position of the knife holder as well as the cutting blade of the knife thereon relative to the corresponding longitudinal edge of the strap being processed. The cutting position may vary the position of the cutting blade at increments of 1/16 of an inch. In a preferred embodiment to be described in greater detail hereinafter the cam structure has a three step structure or configuration defining the full open position and two cutting positions. The aforementioned full open position of the cam allows easy access or positioning of the strap between the cutting blades of the separate knife holders. The locking device associated with the outboard knife holder is loosened so as to facilitate it's inward positioning relative to the corresponding edge of the strap, to accommodate for the width of the strap which it is intended to shape or cut. The untrimmed strap is placed operatively relative to the cutting edges of the separate knives in each of the respective holders with the inboard knife holder in the full open position. Then, after moving the inboard knife holder to one of the cutting positions, the outboard knife holder is then locked in the desired operative position relative to the corresponding strap edge to be trimmed thereby. Now, with the outboard knife holder fixedly adjusted for a desired width, an endless number of straps can be easily inserted or removed from between the knife holders with the inboard knife holder in the full open position. By moving the inboard knife holder to one of the cutting positions, the cutting edges of each of the knife holders are positioned in cutting engagement with the opposite longitudinal edges of the strap.

Once the strap is positioned in the desired orientation relative to the cutting edges of the knives of the holders, a strap supporting assembly is positioned in supporting relation to an undersurface of the strap. This supporting assembly includes an elongated support rod mounted on the two knife holders and selectively adjustable transversely relative thereto and to the length of the strap. This support rod is raised or lowered in proper supporting engagement with the strap to prevent buckling thereof as the strap is pulled through the assembly. As will be explained in greater detail hereafter, the position of the support rod also determines the shaping of the upper or lower positions of the strap edges.

In addition, the strap support assembly includes two spaced apart edge guides each of which are adjustable in relation to the cutting edge of the knives within the respective knife holder. Each of the edge guides are individually adjustable relative to a corresponding knife edge to prevent lateral movement of the strap while effectively guiding the strap edges into cutting engagement with the corresponding knife edges.

BRIEF DESCRIPTION OF THE DRAWINGS

FIG. 3 is a front plan view of the assembly of the present invention.

FIG. 4 is a rear plan view of the embodiment of FIGS. 1 through 3.

Like reference one was referred to like parts throughout the several views of the drawings.

DETAILED DESCRIPTION OF THE PREFERRED EMBODIMENT

Figure 1:
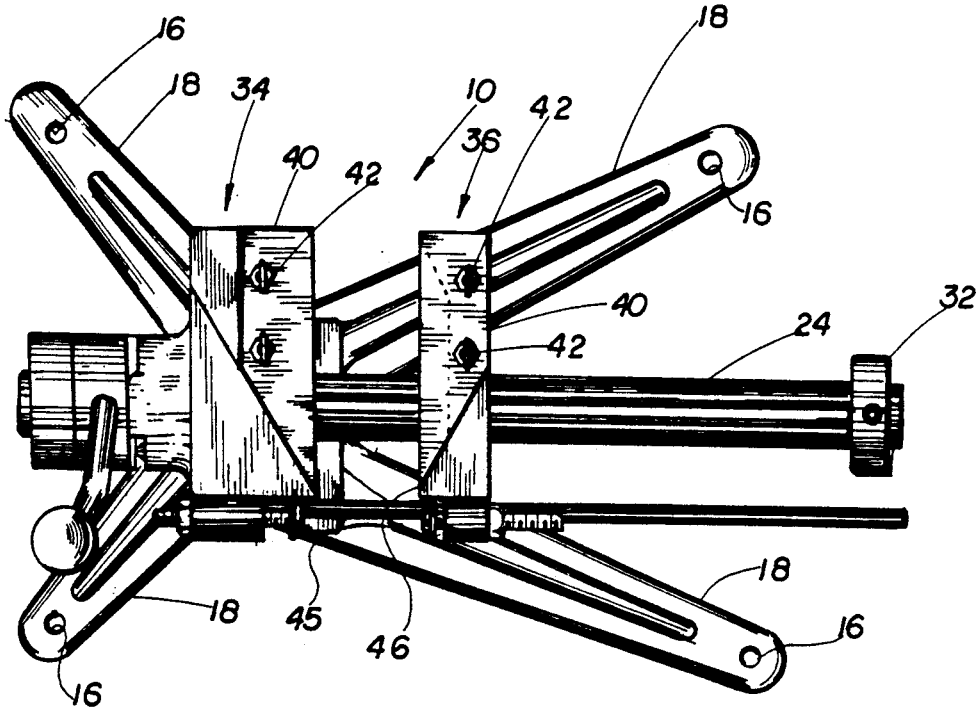
FIG. 1 is a top plan view of the assembly of the present invention.

As shown in FIGS. 1 through 4, the present invention relates to a strap edger assembly generally indicated as 10, and including a base generally indicated as 12, having a support platform 14, designed to be mounted on a work bench, table, etc. by conventional connectors passing through each of the plurality of apertures 16, formed in outwardly extending feet 18, of the support platform 14. The base 12 further includes a main base upright 20, extending upwardly from the platform 14, and secured thereto by a similar conventional type connector 22. Two spaced apart parallel support shafts 24 and 26 are secured to the main base upright 20 by connectors as at 28 so as to extend transversely outward therefrom.

The assembly 10 further includes an inboard knife holder generally indicated as 34 and outboard knife holder generally indicated as 36, each of which are supported on the support shafts 24 and 26 and movable relative to one another along the length of the supporting shafts as indicated in greater detail hereinafter. Each of the knife holders 34 and 36, are structured to include removably but securely mounted knives 38 and 39 positioned thereon. The respective knives may be secured by a knife mount each of which includes a cover plate 40 and a locking thumb screw or like structure 42. The cutting blade 38 and 39, are intended each to be adjustably and precisely disposed in a operative, cutting position, relative to an elongated strap 44, being processed. (see FIG. 2).

The blades 38 and 39 each have a cutting edge 45 and 46, configured to include a plurality of cutting grooves 47 and 48. Each of the corresponding grooves 47 and 48 on the different blades 45 and 46 are congruently dimensioned and configured so as to allow for a congruently shaped cut on the respective longitudinal edges 41 and 43 of the strap 44. Further, the cutting edges 45 and 46 due to their connection to the respective knife holders are preferably slanted somewhat inwardly towards one another at an angle of orientation of at least approximately three degrees from a true parallel position. This is to facilitate cutting of the edges of the strap as at 41 and 43 respectively.

Figure 5:
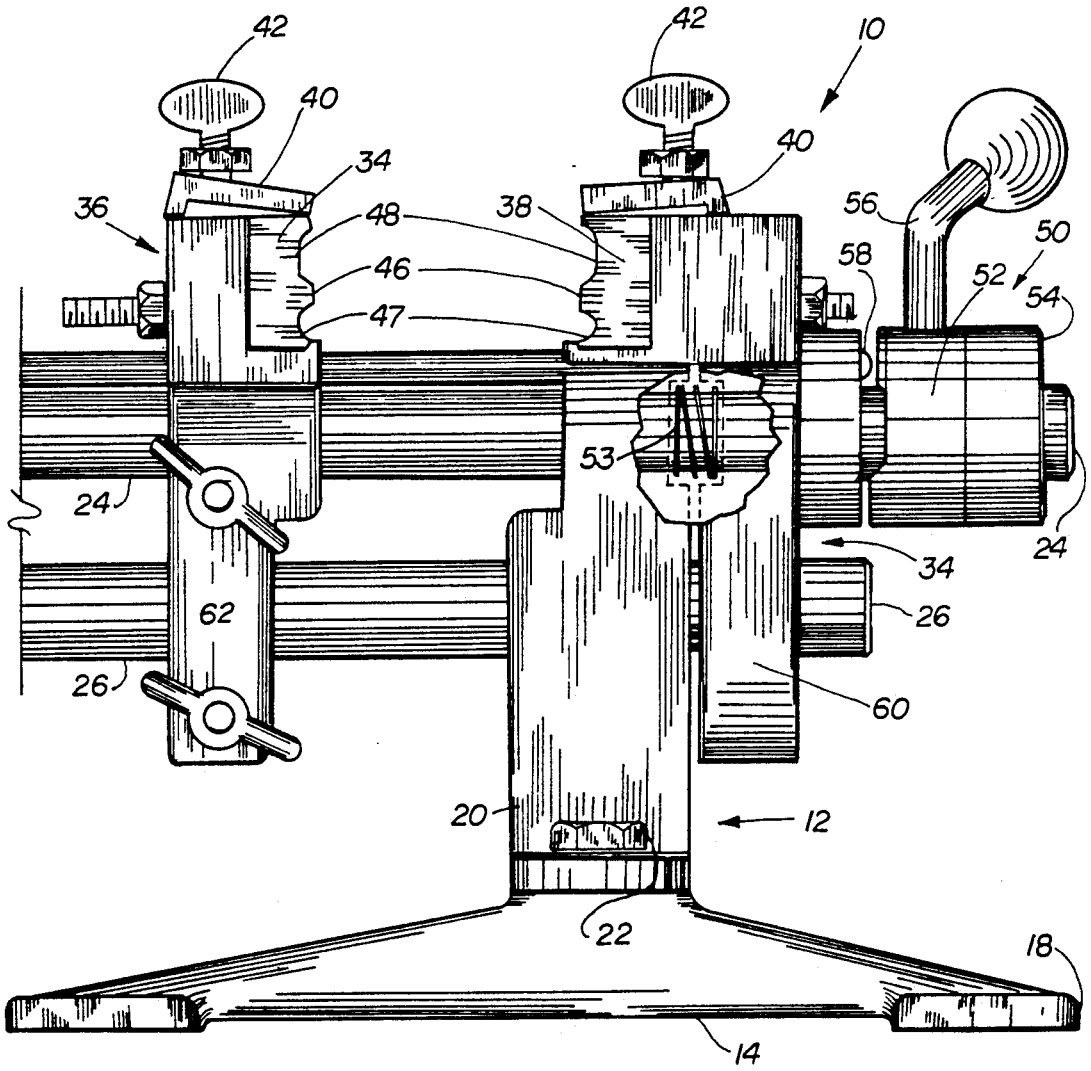
FIG. 5 is an isolated plan view of a biasing spring of an adjustment means of the present invention.

An important feature of the present invention, is the provision of an adjustment means generally indicated as 50. The adjustment means comprises a cam 52, rotatably mounted on the support shaft 24 and maintained in place by a locking ring 54. Rotation of the cam 52 is facilitated by an outwardly extending elongated handle member 56. Preferably, the cam 52, is a three step cam including three separate outwardly extending confronting surface segments disposed at preferably 1/16 inch increments from one another. Accordingly, the cam 52, by manipulation of the handle 56, is rotated between a fully open position (see FIG. 3) wherein a cam rider 58, is effectively disengaged by a first confronting surface segment (not shown) of the cam 52. Also for purposes of clarity, FIG. 5 illustrates an internally mounted spring used in the preferred embodiment which is connected to the main body portion 60, of the inboard knife holder 34, so as to be forced outwardly away from the main base upright 20, due to the spring force exerted thereon. When the cam 52 is located in it's full open position there is no force exerted against this internally mounted spring and the knife holder 34, as well as the blade 38 attached thereto is located at maximum spaced apart distance from the main base upright 20. Rotation or positioning of the cam 52, through manipulation of the handle 56, to a next cutting position serves to force the inboard knife holder 34, as well as the knife blade 38 attached thereto inwardly towards a corresponding longitudinal edge 41 of the strap 44 a distance of preferably 1/16 of an inch, as set forth above. If desired an additional amount may be removed from the corresponding cutting edge 41, by positioning the cam member 52 to its next cutting position thereby further forcing the inboard knife holder 34, inwardly towards the main base upright 20 an additional 1/16 inch, against the force exerted on the knife holder 34, by the internally mounted spring.

As shown best in FIGS. 3 and 4 a locking device including a pair of locking nuts or screws 62 is associated to maintain a fixed interconnection of the outboard knife holder 36, relative to a preferred position on the support shafts 24 and 26. The positioning of the inboard knife holder 34 is accomplished by manipulation of the cam 52 through handle 56, of the adjustment means as set forth above.

Accordingly, in operation the cam 52 is removed to its full open position thereby positioning the inboard knife holder 34, in its maximum disposition away from the main base upright 20. The strap 44 is positioned such that its longitudinal edges 41 and 43, are disposed in pre-determined ones of the grooves 47 or 48 of the blades 38 and 39. Once so positioned the outboard knife holder 36, after having its locking device 62, freed is moved inwardly such that the blade edge 46, is disposed in engagement with the corresponding longitudinal edge 43 of the strap 44. Once so positioned, the left holder 36 is locked into place through manipulation of the locking device 62. The cam 52, is rotated through operation of handle 56 to move the cutting edge 45 of inboard knife holder 34, into one of the two cutting positions separated by the 1/16th inch increments from one another. Such will at least partially determine the amount of material removed from the respective edges 41 and 43 as the respective edges of the strap 44 is pulled manually in the direction indicated by directional arrow 66.

Figure 2:
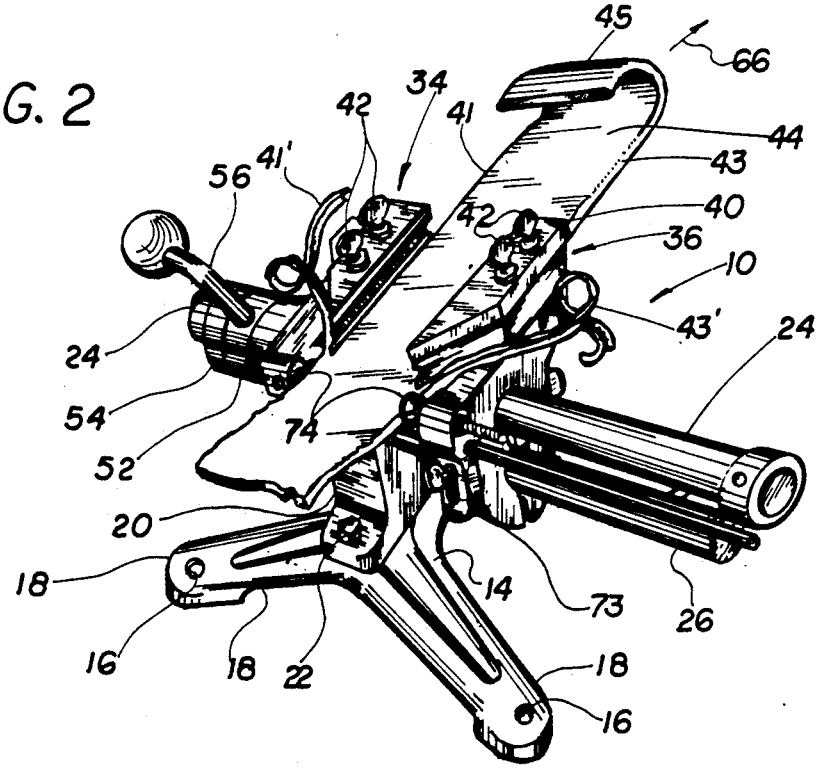
FIG. 2 is a perspective view of the assembly with a strap being processed shown in an operative position relative to the cutting knives thereon.

Other features of the present invention, can include a strap support and guide assembly, including two edge guide structures 70 and 72. Each edge structure includes an elongated threaded element 73 having a guide head 74, which is disposed to engage respectively positioned edges 41 and 43 of the strap and effectively guide such edge relative to the cutting edges 45 and 46 respectively of the blades 39. The position of the guidehead 74, will determine the amount of strap edge 41 or 43 engaged thereby, which is exposed to the cutting edge 45 and 46 of each of the respective cutting blades 39. Depending upon the softness of the material from which the strap 44 is formed the position of the guidehead will further regulate the amount of material as at 41' and 43' removed from the strap 44 as best shown in FIG. 2.

Another portion of the strap guide and support assembly is the support rod 76, which may be adjustably positioned due to elongated slots 78 disposed to receive lock nuts 79 (see FIG. 4) the elongated support rods 76, is thereby moved upwardly or downwardly (transversely) relative to the width of the strap 44 being cut and will be engaged and supported under portion thereof. Due to the fact that the cutting grooves 48 and 49 are curved, the position of the support rod 76 relative to the strap will regulate the amount of material removed from either the upper portion of each edge 41, 43 of the strap 44 or the lower portion thereof.

It can be seen therefor that through proper and precise adjustment of the cam member 52, the guideheads 74, and support rod 76 the configuration and dimension of the longitudinal edges 41, and 43 of the strap 44, can be regulated with great versatility. In addition, the versatility of the structural natures of the assembly 10 of the present invention allows the free end of the strap as at 45 to be easily positioned to allow a firm grip by the operator in order to exert a pulling force in the direction of arrow 66. This pulling force moves the strap 44 through the machine cutting blades 39 for the shaping of the edges 41 and 43 of the strap 44.

Now that the invention has been described:

What is claimed is:

1. A strap edge assembly designed to edge, parallel and/or reduce longitudinal edges of an elongated strap structure to a desired uniform width, said assembly comprising:

a base assembly including a main base upright and a support platform secured to an end of said base upright and disposed in engagement with a supporting surface, two support shafts secured to said main base upright and extending transversely outward therefrom in spaced, parallel relation to one another, an inboard knife holder and an outboard knife holder both movably mounted on said support shafts and said outboard knife holder selectively and fixedly adjustable along the length thereof into and out of operative engagement with a corresponding longitudinal edge of the strap being edged in accordance with the desired uniform width thereof, each knife holder including a knife structure mounted thereon and movable therewith relative to the strap being edged, biasing means interconnected between said inboard knife holder and said main base upright and disposed and structured for normally biasing of said inboard knife holder away from said main base upright, adjustment means mounted on at least one of said support shafts adjacent said inboard knife holder and engageable therewith for selectively moving said inboard knife holder and said knife thereon a predetermined distance along said support shafts between a full open position and a plurality of cutting positions relative to said main base upright and said outboard knife holder, said plurality of cutting positions being defined by selective movement of said inboard knife holder towards said main base upright and said outboard knife holder and against a biasing force exerted by said biasing means so as to position a cutting edge of said knife structure on said inboard knife holder in operative and cutting engagement with the corresponding longitudinal edge of the strap, and whereby placement and removal of the strap from between said knife structures is facilitated by movement of said inboard knife holder to said full open position removing the cutting edge of said knife structure on said inboard knife holder from said cutting engagement with the corresponding longitudinal edge of the strap.

2. An assembly as in claim 1, wherein said adjustment means comprises a cam member mounted in confronting engagement with said inboard knife holder.

3. An assembly as in claim 2, wherein said full open position is defined by maximum outward spacing of said inboard knife holder relative to said main base upright.

4. An assembly as in claim 3, wherein said plurality of closing positions are each further defined by engagement of a different portion of a confronting surface of said cam member with said inboard knife holder and a respectively different position of said knife therein relative to the corresponding edge of the strap.

5. An assembly as in claim 1, further comprising locking means mounted on said outboard knife holder and structured to fixedly secure said outboard knife holder on said supporting shafts relative to the corresponding longitudinal edges of the strap.

6. An assembly as in claim 1, further comprising a strap guide assembly connected to said base assembly and positionable in supporting engagement with the strap being edged and including edge guide means selectively disposable into guiding engagement with the longitudinal edges of the strap and adjustable relative to a cutting edge of the corresponding knife structure for determining the desired uniform width of the strap being edged.

7. An the assembly as in claim 6, wherein said strap guide assembly comprises a support rod adjustably positionable relative to the strap and in supporting engagement therewith.

8. An assembly as in claim 7, wherein said support rod is disposable transversely of the strap into supporting engagement with an undersurface thereof.

9. An assembly as in claim 8, wherein said support rod is movably supported on said knife holders into supporting engagement with the strap.

10. An assembly as in claim 8, wherein said strap guide assembly further comprises edge guides each mounted on a different one of said knife holders and movable therewith along the length of said support rods, said edge guide each positionable relative to the respective knife holder into engagement with a corresponding longitudinal edge of the straps and adjustable positioning of said respective longitudinal edges relative to a corresponding cutting edge of a respective knife structure.

11. An assembly as in claim 1, wherein each knife structure includes a cutting edge having a plurality of grooves integrally formed therein and each groove disposed and configured to cuttingly engage a corresponding longitudinal edge of the strap.

12. An assembly as in claim 11, wherein correspondingly disposed grooves of each cutting edge being congruently dimensioned and configured.

* * * * *